United States Patent [19]

Nishiguchi et al.

[11] Patent Number: 4,805,768

[45] Date of Patent: Feb. 21, 1989

[54] PAPER CONTAINER FOR LIQUID SEALED WITH GAS IN HEAD SPACE, METHOD OF FILLING GAS AND APPARATUS FOR FILLING GAS

[76] Inventors: Youichi Nishiguchi; Kazuo Sasaki, both of No. 12-1, Yurakucho 1-Chome, Chiyoda-Ku, Tokyo, Japan

[21] Appl. No.: 96,786

[22] Filed: Sep. 17, 1987

Related U.S. Application Data

[63] Continuation of Ser. No. 793,272, Oct. 29, 1985, abandoned.

[30] Foreign Application Priority Data

Nov. 2, 1984 [JP] Japan ..... 59-230322
Nov. 6, 1984 [JP] Japan ..... 59-233800

[51] Int. Cl.[4] ..... B65D 85/72

[52] U.S. Cl. ..... 206/213.1; 206/459; 220/DIG. 16; 229/3.5 R; 229/3.5 MF; 426/87; 426/118

[58] Field of Search ..... 53/403, 432, 408, 510; 206/213.1, 205, 524.1–524.6, 459; 220/DIG. 16; 229/3.1, 3.5 R, 3.5 MF, 125.42; 426/106, 111, 87, 124, 112, 118, 127, 130, 131, 394, 395, 397, 410

[56] References Cited

U.S. PATENT DOCUMENTS

| | | | |
|---|---|---|---|
| 2,040,798 | 5/1936 | Schoonmaker | 220/DIG. 16 |
| 2,173,585 | 9/1939 | Harrison | 229/3.1 |
| 2,194,004 | 3/1940 | Buckolt | 426/87 |
| 2,279,155 | 4/1942 | Wright | 220/DIG. 16 |
| 2,442,161 | 5/1948 | Bergstein | 53/432 |
| 2,506,769 | 5/1950 | Bergstein | 53/432 |
| 2,661,141 | 12/1953 | Zinn, Jr. | 229/3.5 R |
| 2,753,268 | 7/1956 | Ingle et al. | 426/410 |
| 2,967,777 | 1/1961 | Grindrod | 426/410 |
| 2,996,233 | 8/1961 | Craig et al. | 229/125.42 |
| 3,393,077 | 7/1968 | Moreau | 426/410 |
| 3,477,192 | 11/1969 | Brown et al. | 206/524.4 |
| 4,055,672 | 10/1977 | Hirsch et al. | 426/129 |
| 4,221,820 | 9/1980 | Jentsch | 426/410 |
| 4,409,252 | 10/1983 | Buschkens et al. | 426/392 |
| 4,525,396 | 6/1985 | Tasaka et al. | 229/3.1 |

FOREIGN PATENT DOCUMENTS

| | | |
|---|---|---|
| 2612958 | 3/1976 | Fed. Rep. of Germany . |
| 3108817 | 3/1981 | Fed. Rep. of Germany . |
| 3226172 | 7/1982 | Fed. Rep. of Germany . |

OTHER PUBLICATIONS

Crowe, "Gas Atmosphere Preservation", Modern Packaging, Oct. 1969, pp. 183–189.

*Primary Examiner*—Jimmy G. Foster
*Attorney, Agent, or Firm*—Parkhurst, Oliff & Berridge

[57] ABSTRACT

A paper container filling a liquid content which comprises an upper air gap formed therein for sealing solely carbon dioxide or nitrogen gas and carbon dioxide. Thus, a recess is produced on the paper container by utilizing a small pressure reduction in the container generated as a result of carbon dioxide dissolved in the liquid content, and the recess is used as a criterion of deciding the presence of gas substitution, presence of pinhole of the container and the propriety of sealing of the container only by the recess. This container can be fully inspected by the naked eye. Further, a method of filling gas and apparatus for filling the gas in a composite paper container including aluminum foil or polyethylene by eliminating the abovementioned disadvantages and performing gas substitution merely by adding a simple unit on a filling machine, thereby holding taste, odor and nutrient components of the container contents for 4 or longer months.

2 Claims, 4 Drawing Sheets

PAPER CONTAINER FOR LIQUID SEALED WITH GAS IN HEAD SPACE, METHOD OF FILLING GAS AND APPARATUS FOR FILLING GAS

This is a continuation of application Ser. No. 793,272, filed Oct. 29, 1985, now abandoned.

BACKGROUND OF THE INVENTION

This invention relates to a paper container for liquid and, more particularly, to a paper container for liquid sealed with gas in a head space formed in the top of the container after filling liquid therein, a method of filling the gas in the container and apparatus for filling the same gas.

A paper container for liquid is sealed by a packaging method to prevent bacteria or air from externally entering so as to increase the lifetime or shelf life of the contents in the same manner as a container such as a can or a bottle.

Particularly, juice drink, milk drink or coffee drink are known to be oxidized in the effective components by oxygen in the air, remarkably varied in taste or color, and corroded in the content by bacteria in the air deteriorating the value of merchandise in a short time.

Therefore, paper containers for the liquids are sealed from external atmosphere by packaging materials formed by laminating aluminum foil or synthetic resin film having low gas permeability on paper. Further, liquid heated for sterilization and then cooled is filled in a container sterilized to prevent the content from corroding to generally perform a so-called sterilization charging.

Moreover, immediately after the content liquid food is heated to 60 to 95° C., the liquid is filled, sealed in the sterilized container to prevent bacteria from entering the container to normally perform a so-called packing method by hot filling. According to this method, air of the head space is evacuated out of the container by the vapor of the liquid food and the container is then sealed. Thus, the influence of the air to the content can be suppressed to some degree, but certain change of quality of the content liquid due to heat cannot be avoided.

In order to prevent the influence of the air in the head space of the container, the air in the head space is replaced by carbon dioxide gas or nitrogen gas in the container for filling solid content. However, when the carbon dioxide gas is used in a liquid food filling container, in many cases the gas is dissolved in the content to affect the taste of the food. Thus, this cannot be performed practically.

When the gas charge packing with nitrogen gas is applied to a paper container for liquid, it is naturally necessary to inspect the presence of gas substitution, the in pinholes of the container and the propriety of sealing of the container before delivering the container. Methods of inspecting the container include a method of removing and analyzing gas from a product, and a method of removing the content liquid by opening the container and inspecting it. In any of these methods, the inspected container cannot be recovered as merchandise, and the inspection takes a large quantity of time for no practical use. Therefore, there is no other way than a sampling inspection to test the reliability of the contents.

SUMMARY OF THE INVENTION

This invention is made to consider the abovementioned circumstances to provide a paper container for liquid which can be fully inspected by the naked eye.

Inventors of this invention have completed this invention by discovering that a container was deformed by a small pressure reduction due to the dissolving of carbon dioxide gas sealed in the container in the content solution and the deformation was represented as a recess on the top of the panel of the wall of the container in the pressure reduction after filling the content liquid.

More particularly, this invention provides a paper container filling a liquid content which comprises an upper air gap formed therein for sealing only carbon dioxide or a mixture of nitrogen and carbon dioxide. Thus, a recess is produced on the container by utilizing a small pressure reduction in the container generated as a result that the carbon dioxide is dissolved in the liquid content, and the recess is used as a criterion of deciding the presence of gas substitution, presence of pinholes in the container and the propriety of sealing of the container only by the recess.

Therefore, the mixing ratio by volume of the nitrogen gas to the carbon dioxide gas is determined by considering the strength of the material of the container, the shape and size of the container and the volume of the head space. In any case, it is necessary to seal the carbon diozide gas of the degree for producing a recess on the top of the panel of the wall of the container by the pressure reduction due to the dissolving of the carbon dioxide gas in the content.

In paper containers for liquid of various types, approx. 30% of carbon dioxide gas of the volume of the head space is sufficient in the container having large pressure reduction effect, and 1:1 ratio of nitrogen gas to carbon dioxide gas is sufficient even to form a recess in the normal paper container in which a recess is hardly produced.

However, with some liquids carbon dioxide gas dissolved in the liquid content does not normally affect the taste of the liquid content, but rather affects a preferable influence. In the case of a large-sized container of 1 liter for filling food affected by the preferable influence of the carbon dioxide gas, a preferable recess may be expected to be formed by filling only with carbon dioxide gas. However, in case of a small-sized paper container of 500 milli-liter or less, the paper container might be abnormally deformed due to a number of recesses. Thus, the mixing ratio of carbon dioxide gas is important to be of the minimum limit as required.

The foregoing objects and other objects as well as the characteristic features of the invention will become more fully apparent and more readily understandable by the following description and the appended claims when read in conjunction with the accompanying drawings.

DESCRIPTION OF THE PREFERRED EMBODIMENTS

Embodiments of the container for liquid constructed according to this invention will now be described in detail with reference to the accompanying drawings.

Figure 1:
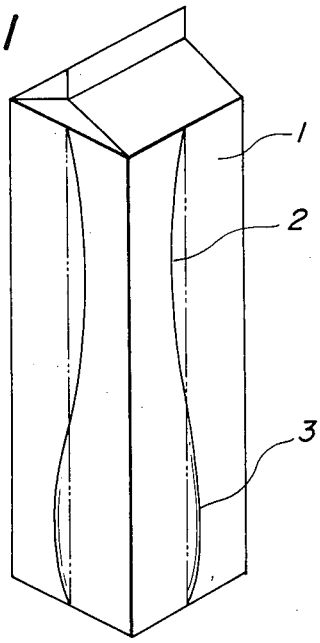
FIG. 1 is a perspective view of a paper container for liquid according to this invention.
Figure 2:
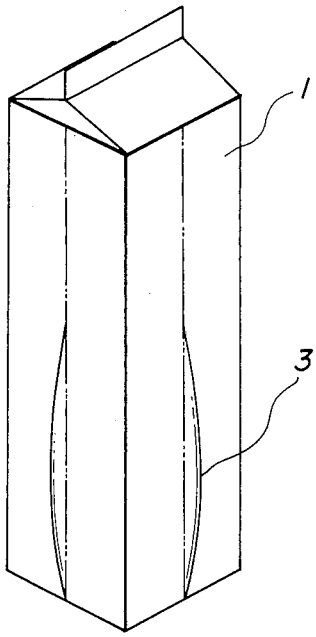
FIG. 2 is a perspective view of a liquid paper container in which inert gas is totally substituted in place of air in the head space.
Figure 3:
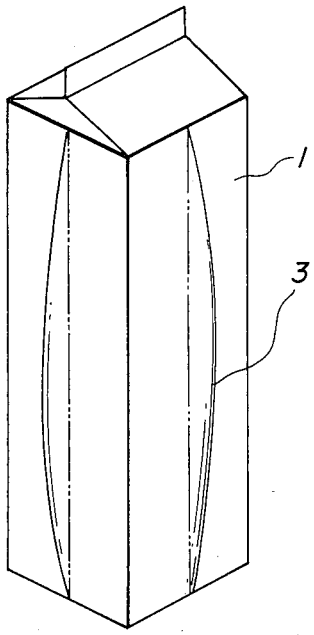
FIG. 3 is a perspective view of an improper body swelled container.

This invention can be applied to containers of 80 ml, 180 ml, 200 ml, 250 ml, 500 ml, 1,000 ml, and 2,000 ml or larger. FIGS. 1 to 3 show gable-top type containers of 1,000 ml in various states of good and band products. FIG. 1 is a perspective view of the container to be sorted as a good container according to this invention. A recess 2 is formed on the upper portion of the wall panel of the container 1, and a swell 3 is formed on the lower portion of the container 1. FIG. 2 shows a container in which nitrogen is totally substituted in place of air in the head space, a swell 3 of the lower portion is formed, but a recess of the upper portion is not observed. A conventional paper container in which gas is not substituted is similarly observed. FIG. 3 is a container to be sorted to a bad container. A swell 3 caused by the corrosion or deterioration in the quality of the content is observed on the entire container.

In this invention, nitrogen gas and carbon dioxide gas may be filled in a premixed state, but separate nozzles for the respective gases are preferably used from the viewpoint of operation and facility of the substituting apparatus.

Carbon dioxide is mixed in nitrogen gas, part of the carbon dioxide being dissolved in the content liquid, with the result that the volume of the head space is reduced. The influence of the reduction in the volume to the profile of the container cannot be generally pointed out due to the difference according to the types of containers, the sorts of the content liquid, filling conditions and preserving state. For example, in the case of a container for milk of 1,000 ml, 2 to 3 mm of a recess is formed at the position of the height of approx. ¼ from the top of the container as a center.

If an improper sealing or an inspection for the presence of pinholes or gas substitution is not performed, this recess is obviated by the corrosion or deterioration in the quality resulting from the invasion of bacteria from the exterior, inflowing of air (oxygen) or mixture of other foreign material after a predetermined period if elapsed from the sealing time, and a swell of 5 to 8 mm, which is normally called "a body swell" is exhibited. In other words, the identification of the recess and the body well can be simply discriminated in appearance, thereby readily discriminating whether the container is complete or defective.

Examples of the container for liquid according to this invention will now be described in detail.

EXAMPLE 1

160 of gable-top type containers (trade name: Purepack) of 1,000 ml in volume sealed at a bottom were prepared, and 1,000 ml of distilled water at 20° C. was filled in the respective containers. Carbon dioxide and nitrogen of these gases or mixture gas of various ratios were substituted in place of air in the head spaces of each of 20 containers, and the containers were sealed at the tops. In addition, after distilled water was filled in the respective containers, 20 containers were each selected and 20 containers were each not sealed at the tops without gas substitution as reference I and II respectively. After the containers were preserved at room temperatures for two months, the head spaces were measured in volume, and acidic taste function tests were conducted by 10 panellers.

The results are listed in Table 1. The head spaces of the containers substituted completely by nitrogen gas exhibited swells on the lower portions of the container as shown in FIG. 1, but held the shape near a square shape in horizontal section. The references I and II exhibited similar states and had the same volume as the normal paper container sealed without gas substitution.

When carbon dioxide gas was mixed at 70:30 or higher of volumertric ratio of carbon dioxide gas to nitrogen gas, the volume of the head space started reducing, and a recess on the upper portion of the container as shown in FIG. 1 could be clearly observed with the naked eye.

Acidic taste could not be identified from the reference I in ranges of 90:10 to 50:50 of volumetric ratio of nitrogen and carbon dioxide gases, but when exceeding 20:80, the acidic taste could be felt, and could be identified.

EXAMPLE 2

One hundred sixty containers of 1,000 ml each of 100% orange juice (containing 40 mg % of vitamin C) using the same containers as those in the Example 1 were sterilized by UHT, and the juice was cooled to 10° C. Then only nitrogen gas and carbon dioxide gas or a mixture thereof was substituted in place of the air in the head spaces, and the containers were sealed at the tops. In addition, each of twenty containers were prepared as reference III without gas substitution and as reference IV without gas substitution and UHT sterilization.

The filled containers above were further divided into two groups of ten containers. The first group of ten containers was allowed to stand for 5 min., the volumes of the head spaces and the recesses (the maximum recesses) on the upper portions of the containers, and the swells were measured, and the average values were obtained. On the other hand, the second group of ten containers was preserved for 3 months at the longest at 25° C., and Vitamin C was measured at every one month. In the containers of 1,000 ml, the maximum recesses of the containers were observed at the height of approx. ¼ from the top of the square post except the gable portion. Therefore, the maximum recesses were actually measured at 50 mm from the top, and the maximum swells were actually measured at 50 mm from the bottom. The test results are listed in Tables 2 and 3.

As apparent from Table 2, the volumes of the head spaces of the containers of the first group exhibited substantially the same value as those in Table 1 of the containers for filling water. The references IV not sterilized were corroded, and upper and lower portions of the containers were both swelled, and can be simply identified with the naked eye from the other containers sterilized.

The containers in which liquid foods were filled within ranges of 70:30 to 50:50 of the ratio of nitrogen gas to carbon dioxide gas and the air of the head spaces were replaced can be simply identified by the external appearance of the containers from the uneven state of the upper portions of the container and the presence of gas substitution and presence of the corrosion without failing the taste.

The contents of vitamin C exhibited 40 mg % immediately after filling. The contents of vitamin C were slightly reduced after one month to 35 mg %. The following variation was less, and even after 3 months, 30 to 33 % were exhibited. The references III without filling gas reduced vitamin C at ageing time due to oxidation, and after 3 months, it was reduced by half as compared with that immediately after filling.

TABLE 1

| | Test result for container filling distilled water | | | | | | | | | |
|---|---|---|---|---|---|---|---|---|---|---|
| | Ratio of mixture gas by volume $N_2$:$CO_2$ | | | | | | | | Ref I Not sub. | Ref II Not sub. |
| | 100:0 | 90:10 | 80:20 | 70:30 | 50:50 | 30:70 | 20:80 | 0:100 | (Top seal) | (Top not sealed) |
| Head space (ml) | 50 | 47 | 43 | 38 | 28 | 18 | 15 | 3 | 50 | 50 |
| Presence of acidic taste# | Non | Non | Non | Non | Non | — | Yes | Yes | Non | Non |

#Two points with the reference I by 10 panellers were identified, "Yes" means that 5 or more could identify, and "Non" means that all 10 could not identify, and "—" means both "Yes" and "Non".

#Two points with the reference I by 10 panellers were identified, "Yes" means that 5 or more could identify, and "Non" means that all 10 could not identify, and "-" means both "Yes" and "Non".

TABLE 2

| | Test result (1) of orange juice filled containers | | | | | | | | | |
|---|---|---|---|---|---|---|---|---|---|---|
| | Ratio of mixture gas by volume $N_2$:$CO_2$ | | | | | | | | | |
| | 100:0 | 90:10 | 80:20 | 70:30 | 50:50 | 30:70 | 20:80 | 0:100 | Ref III | Ref IV |
| Head space (ml) | 50 | 47 | 44 | 43 | 35 | 21 | 18 | 3 | 50 | 80 |
| Max. depth of recess (mm) | 0 | 0.1 | 0.3 | 0.5 | 1 | 1 | 1.5 | 2.5 | 0 | (swell) 2.3 |
| Max. size of swell (mm) | 3 | 2.2 | 2.6 | 2.6 | 2.6 | 2.6 | 2.6 | 2.5 | 3 | 5 |

TABLE 3

| | Test result (2) of orange juice filled containers | | | | | | | | |
|---|---|---|---|---|---|---|---|---|---|
| | Ratio of mixture gas by volume $N_2$:$CO_2$ | | | | | | | | Ref |
| | 100:0 | 90:10 | 80:20 | 70:30 | 50:50 | 30:70 | 20:80 | 0:100 | III |
| Reduced Vitamin mg % | | | | | | | | | |
| After filling | 40 | 40 | 40 | 40 | 40 | 40 | 40 | 40 | 40 |
| After 1 month | 35 | 35 | 35 | 35 | 35 | 35 | 35 | 35 | 30 |
| After 2 months | 35 | 33 | 32 | 33 | 33 | 34 | 32 | 34 | 26 |
| After 3 months | 33 | 32 | 30 | 33 | 33 | 32 | 31 | 33 | 20 |

The container in which gas substitution is performed in the head space with mixture gas according to this invention can eliminate improper sealing, pinholes, and when the gas substitution is complete, a small recess is formed on the upper portion of the container to identify the index of preferable product. On the other hand, with improper sealing, pinholes can be identified by the body swell of the container, and the incomplete gas substitution is identified by the absence of the recess on the upper surface of the container.

As described above, since this invention can activate the properties of the container, sampling inspection can be eliminated and the check by the naked eye can be performed. Thus, sorting works of the containers can be effectively and simply conducted.

A method of filling gas in the paper container to prevent the content filled therein from oxidizing and an apparatus for filling the same gas of the invention will now be described in detail.

A method of sealing inert gas in the head space of a metallic can, a glass bottle or a plastic container by dropping liquid droplets of inert gas in the container or injecting gas as vapor from a nozzle was heretofore widely carried out. However, a technique for substituting for gas in a paper container formed with a head space for liquid has been relatively newly discussed. For example, Japanese Patent Laid-Open Nos. 73521/83 and 216526/83 official gazettes disclose a method of blowing gas from below through a transparent membrane for passing gas without passing liquid under water or by sealing a middle cover and then overturning a container. This method employs a special transmission membrane, a large-sized gas blowing device, and cannot insert a gas substitution step into a filling machine only by partly improving the normally used machine. A conventional method by dropping liquid droplets of inert gas causes the internal pressure of the liquid paper container after it is sealed at the top to become excessive due to the vaporization of the liquid droplet, thereby damaging the paper container, resulting in the impossibility of practically employing this method.

Taste, odor and nutrient components of the content liquid such as juice are varied as time is elapsed due to the oxidation with oxygen contained in the remaining air in the paper container after sealing. The conventional technique for gas substitution for preventing the content in the container from oxidizing includes the abovementioned disadvantages.

This invention provides a method of filling gas and air apparatus for filling the gas in a composite paper container including aluminum foil or polyethylene mainly with paper by eliminating the abovementioned disadvantages and performing gas substitution merely by adding a simple unit on a filling machine, thereby holding taste, odor and nutrient components of the contents in the container for 4 or longer months.

In order to eliminate the aforementioned disadvantages, this invention provides a method of filling and sealing a paper container for liquid by forming the container having a head space at the top thereof on a filling machine, which comprises the steps of filling content solution in the container, then substituting air present in the head space of the container with inert gas injected into the head space immediately before sealing the top of the container. Further, in order to execute the method, there is provided an inert gas substituting apparatus for a liquid paper container which comprises a gas substitution station between the filling station and the sealing station of the filling machine, a gas filling nozzle provided elevationally movably at a position immediately before sealing the top of the paper container filled with the content in the gas substitution station between a position higher than the upper edge of the container filled with the liquid and a distance of the degree not generating a splash by the injection of the gas from the filling content level.

The filling machine is disposed as the substituting apparatus at the position to approach the top sealing fins of top bonding unit of the gable-top type liquid container from both sides after filling while preliminarily heating the top sealing fins to heat-seal the fins, and the position is used as one or two gas substitution stations, a gas filling nozzle of bore of suitable range is provided, the gas injection port of the nozzle is approached to the liquid level in the container, inert gas is injected at a suitable outflowing velocity to perform the gas substitution, and the top sealing fins are sealed immediately thereafter to completely seal the liquid filled container.

When the method and the apparatus are thus constructed, it is not necessary to associate the expensive inert gas substituting apparatus in the filling machine, the gas substitution station can be provided by utilizing the space before the sealing station of the filling machine, thereby performing the gas substitution of the paper container for liquid, thereby executing the prevention of the oxidation and deterioration in the preferable taste, odor and nutrient components of the content initially filled in the container to preserve the content for 4 or longer months.

A method of filling gas and an apparatus for filling the gas according to this invention will now be described in detail with reference to embodiments.

Figure 4:
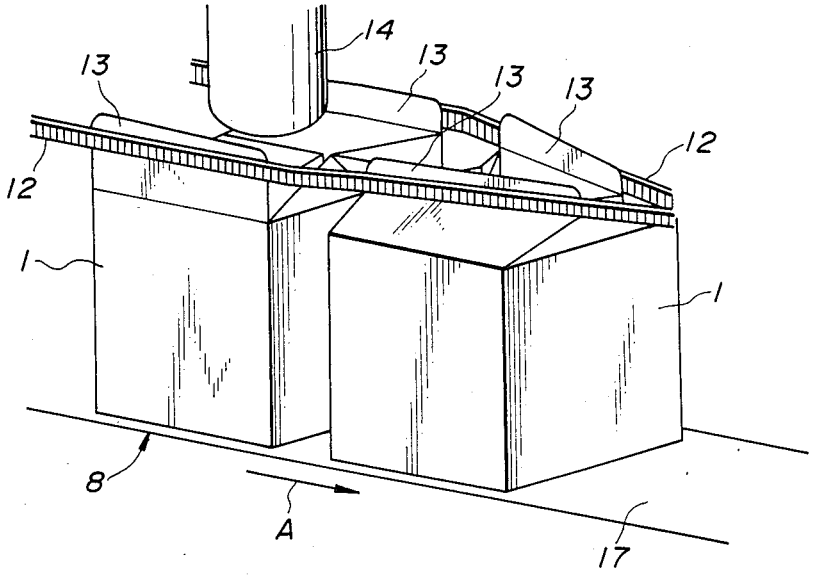
FIG. 4 is a perspective view of an embodiment of a gas substitution station according to this invention.
Figure 5:
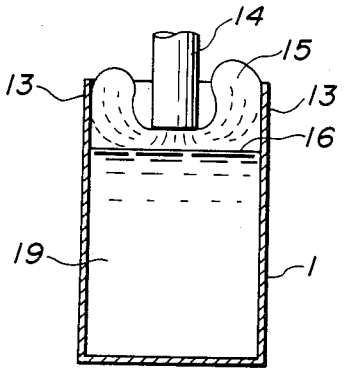
FIG. 5 is a central longitudinal sectional view of the container showing the inert gas injecting state of the gas substitution station.
Figure 6:
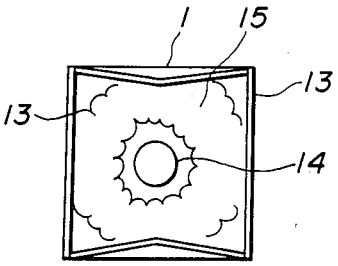
FIG. 6 is a plan view of the station.

An embodiment shown in FIGS. 4 to 6 will be first described. As shown in FIG. 4, the paper containers 1 of gable-top type filled with the content by the filling station (not shown) of the filling machine in the filling step are sequentially slidably contacted at top rail fins 13 with guide rails 12 on the filling machine, and moved to the sealing station (not shown) in the top sealing step on a conveyor 17 in a direction of an arrow A.

The guide rails 12, 12 are provided at both sides in the moving direction of the paper containers 1, spaced at an interval slightly larger than the width of the container 1 at the filling station side (at the left side of FIG. 4), then maintained substantially in parallel at a substantially equal interval to the width of the container 1, and further narrowed gradually at an interval between the fins 13 and 13 of both sides of the container 1 as the container 1 approaches the sealing station side (left side of FIG. 4).

In the embodiment described above, the zone of the guide rails 12, 12 in which the width is formed substantially in parallel at the substantially equal interval to the width of the container 1 is used as the gas substitution station 18 in the gas substituting step.

A gas filling nozzle 14 is vertically suspended directly above the container 1 of the station 18. The nozzle 14 is formed with a port of relatively large diameter so as to reduce the outflowing velocity of the inert gas, and provided elevationally movably between the upper limit position higher than the upper edge of the container 1 and the lower limit position lower in the degree for not causing a splash from the liquid level 16 of the content liquid 9 in the container 1 when injecting inert gas from the nozzle in the container 1 as shown in FIG. 5.

While the nozzle 14 is moved down to the lower limit position, the inert gas is injected at a predetermined injecting velocity from the nozzle 14 for a predetermined period (several seconds). The abovementioned lower limit position and the inert gas injecting velocity are set to a considerably fast value within the limit for not causing a splash from the liquid level or surface 16, the diameter of the port of the nozzle 14 is formed considerably large within a range not in contact with the container 1, and the opening area of the nozzle 14 is preferably set to the value near 30% of the opening area of the container 1.

FIGS. 5 and 6 show a gas substitution state.

The inert gas injected from the end of the nozzle 14 moved to the vicinity of the liquid level or surface 16 is diffused in the container 1 as shown by the injected gas stream 15. More particularly, the inert gas is injected toward the liquid surface 16, diffused on the inner wall of the container 1, then tends to spread in a cloud shape of a lump directed slightly upward in a thickness of a certain degree along the top sealing fins 13. The velocity of the inert gas directly upward of the lump is determined from the relationship among the density ratio of the inert gas and the air, the outflowing velocity and the head space in the container 1 on the liquid surface 6.

The moving surface of a conveyor 17 moving by placing the container 1 cannot be altered due to the installation of the gas substituting step since the filling step and the top sealing step are previously set around the gas substituting step.

The gas substituting step can be finished in a short time since the gas outflowing velocity is faster than the velocity of the conveyor. As shown in FIG. 4, the container 1 disposed after gas substitution disposed at the sealing station side (right side of FIG. 4) in the moving direction of the conveyor 17 is opened at the opening during a slight period in the meantime to the top sealing step during which the fins 13 are gradually closed, and air might be introduced into the container 1 after gas substituting.

To avoid this, the inert gas is injected slightly more than the head space on the liquid surface 16 of the container 1, thereby externally flowing a small amount of inert gas upwardly in the step of gradually closing the fins 13 as the container 1 at the middle right side of FIG. 4, and the fins 13 are thermally sealed in the state that the inert gas is filled substantially in the head space, thereby sealing the container 1.

Figure 7:
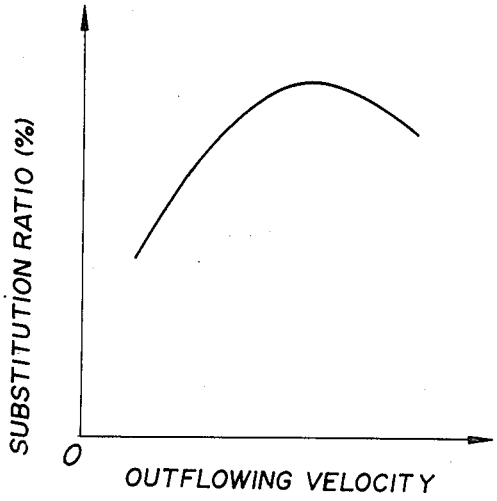
FIG. 7 is a graph showing the relationship between the inert gas outflowing velocity and the substitution ratio.
Figure 8:
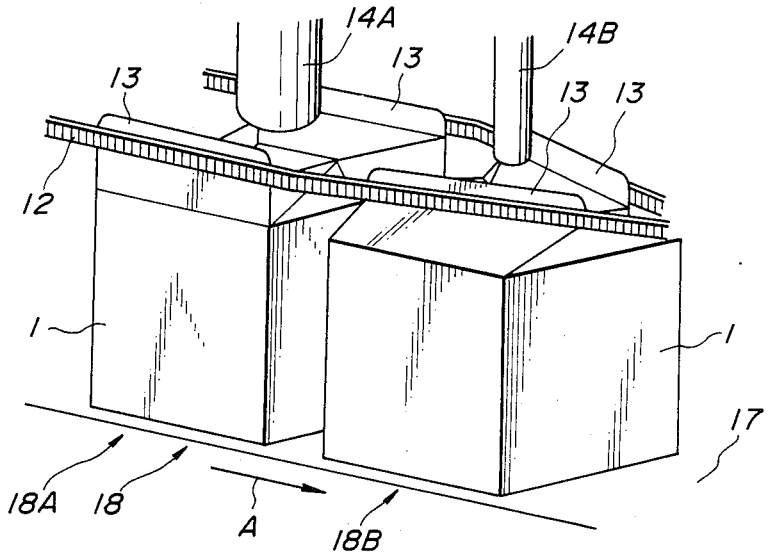
FIG. 8 is a perspective view of another embodiment of a gas substitution station according to this invention.

As a result of an experiment that the outflowing velocity of the inert gas and the substitution ratio of the air in the head space were measured while the outflowing velocity was varied, a graph in FIG. 7 was obtained. As in this graph, it was discovered that, as the outflowing velocity of the inert gas increases, the substitution ratio increases, but if the outflowing velocity is excessively increased, the substitution ratio is reversely decreased. Therefore, in order to reduce the loss of the inert gas and to completely substitute for the gas, the optimum values of the magnitude of the head space of the container 1, the magnitude of the inner diameter of the nozzle 14, the injection amount of the inert gas, the injecting time and the outflowing velocity must be experimentally determined.

Another embodiment shown in FIGS. 8 to 12 will now be described in detail. In this embodiment, the gas substituting step is conducted in the same manner as the previous embodiment between the gas substitution station 18 provided intermediately between the filling step and the top sealing step, but the substitution station is divided into a first gas substitution station 18A near the filling station shown at the left side of FIG. 8 and a second gas substitution station 18B near the sealing station shown at the right side, and the gas substituting step is accordingly composed of a first gas substituting step conducted at the first gas substitution station 18A and a second gas substituting step conducted at the second gas substitution station 18B.

The first station 18A is provided subsequently to the filling station, and a first gas filling nozzle 14A having large diameter is elevationally movable suspended in a wide range of the opening area of the container 1 on the conveyor 17.

The second station 18B is provided subsequently to the first gas substitution station 18A in a range for narrowing the opening area of the container 1, and a second gas filling nozzle 14B of small diameter is elevationally movably provided.

Figure 9:
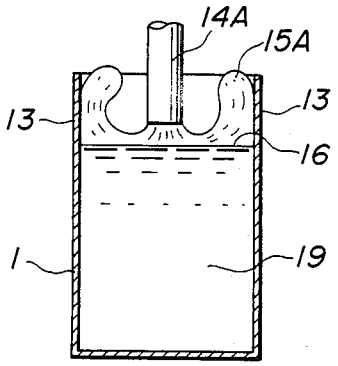
FIG. 9 is a central longitudinal sectional view of the container showing the inert gas injecting state in the first gas substitution station.
Figure 10:
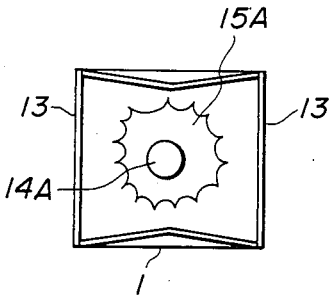
FIG. 10 is a plan view of the first gas substitution station.
Figure 11:
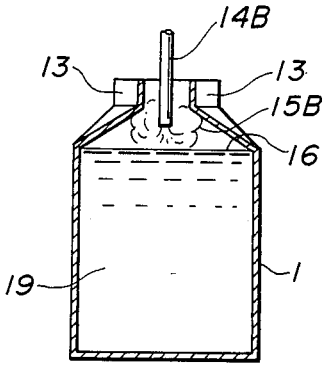
FIG. 11 is a central longitudinal sectional view of the second gas substitution station showing the inert gas injecting state.
Figure 12:
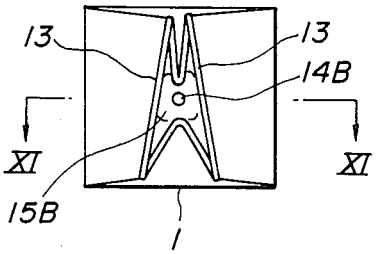
FIG. 12 is a plan view of the second gas substitution station.

The container 1 carried by the conveyor 17 from the filling station to the first station 18A is, as shown in FIGS. 9 and 10, filled with the inert gas into the head space as shown by 15A in a short time by the nozzle 14 in the previous embodiment by the nozzle 14A moved down on the liquid surface 16 in the container 1, thereby eliminating the wasteful inert gas flowing to the upper outside of the head space. In this case, the air in the head space is not completely substituted for the inert gas. The container 1 of this state is then carried by the conveyor 17 to the second station 18B, and the inert gas shown by 15B is injected at relatively faster speed by the second nozzle 14B of finer diameter moved down into the opening narowed as shown in FIGS. 11 and 12. The space not filled by the first injection in the head space narrowed as shown in FIGS. 11 and 12 can be filled with the inert gas by the second injection to reduce the loss of the inert gas, and the container is immediately carried to the sealing station in the state that the head space is completely substituted.

The reason why the second nozzle 14B is formed narrower is because both the fins 13, 13 are narrowed in the opening to the almost closed state as the interval between the rails 12 and 12 is narrowed, and this opening can be inserted without fail.

According to this invention as described above, the method of filling the inert gas and apparatus for filling the gas does not need the use of a gas transmission membrane, nor the facility of gas substituting by overturning the liquid container, and performs the gas substitution merely by slightly improving to provide the gas filling nozzle by utilizing the gas substitution station intermediately between the heating step and the top sealing step on the conventional filling machine, thereby reducing the improving cost to perform the gas substitution without decelerating the conveyor speed and hence the filling and sealing speed as a whole.

We claim:

1. A gas-tightly sealed container, comprising:

walls defining said container having an inside volume; and at least one wall adapted to be flexed inwardly solely upon a reduction in pressure of said inside volume of said container to form an inward flexure, said container having a liquid and a gas sealed therein and said inside volume of said container being greater than the volume of the liquid such that a head space is formed between an upper surface of the liquid and a top of said container, said gas occupying the head space in said container and consisting essentially of a member selected from the group consisting of carbon dioxide and mixtures of carbon dioxide with nitrogen, wherein the volumetric ratio of carbon dioxide to nitrogen in the head space is from 100:0 to 30:70;

wherein, dissolution of said carbon dioxide in said liquid reduces the pressure of said inside volume of said container thereby forming said inward flexure along an upper portion of said wall, said inward flexure providing an indication of proper gas substitution and proper sealing of said container and the absence of pinholes in said container.

2. The sealed container according to claim 1, wherein the volumetric ratio of carbon dioxide to nitrogen is from 100:0 to 70:30.

* * * * *